United States Patent [19]

Coates et al.

[11] Patent Number: 4,774,729

[45] Date of Patent: Oct. 4, 1988

[54] ATHLETIC HELMET FACE MASK ATTACHMENT

[76] Inventors: Thomas B. Coates, 1834 Mershon, An Arbor, Mich. 48104; John H. Roth, deceased, Ann Arbor, Mich.; Marjorie H. Roth, 1008 Sunnyside, Ann Arbor, Mich. 48103, executrix of said John H. Roth, deceased

[21] Appl. No.: 61,798

[22] Filed: Jun. 15, 1987

[51] Int. Cl.[4] ..... A63B 71/10

[52] U.S. Cl. ..... 2/424; 2/425

[58] Field of Search ..... 2/9, 206, 411, 422, 2/424, 425

[56] References Cited

U.S. PATENT DOCUMENTS 2,908,911 10/1959 Sowle ..... 2/424 X
4,363,140 12/1982 Correale ..... 2/9
4,370,759 2/1983 Zide ..... 2/424

FOREIGN PATENT DOCUMENTS 1116801 1/1982 Canada ..... 2/425

*Primary Examiner*—Wm. Carter Reynolds
*Attorney, Agent, or Firm*—James M. Deimen

[57] ABSTRACT

A new attachment configuration for the face mask of a football or ice hockey helmet comprising three snap-in attachments that permit detachment of the face mask with sufficient pulling or twisting movement of the mask. The snap-in attachments are configured to resist without detachment sudden impacts and jarring regardless of direction. The attachments thereby prevent removal of the face mask from the helmet in normal play but reduce the likelihood of neck injury to the player in the event the face mask is accidentally or purposely grabbed in play. Each attachment comprises a plastic clip fastened to the helmet and formed with an elongated aperture adapted to receive the bottom of a U-shaped bar extending from the mask.

14 Claims, 2 Drawing Sheets

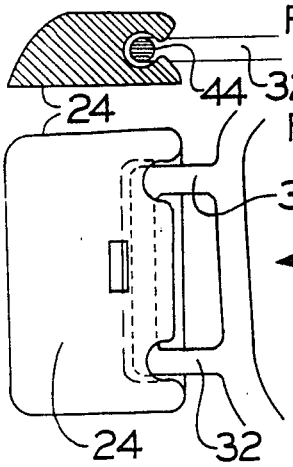
FIGURE 6. A
48
44
32
24
FIGURE 6. B
32
48
24
32
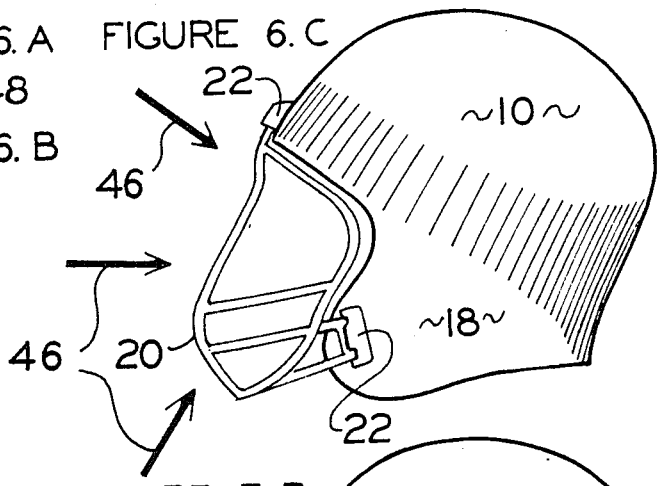
FIGURE 6. C
22
~10~
46
46
20
~18~
22
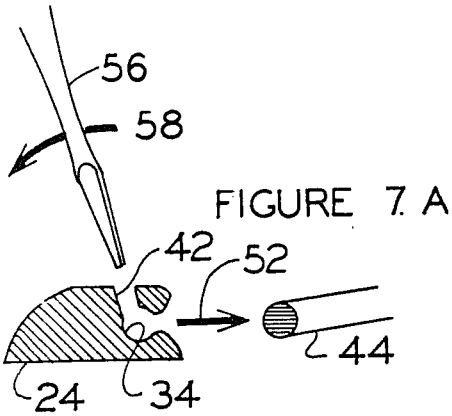
56
58
FIGURE 7. A
42
52
44
24
34
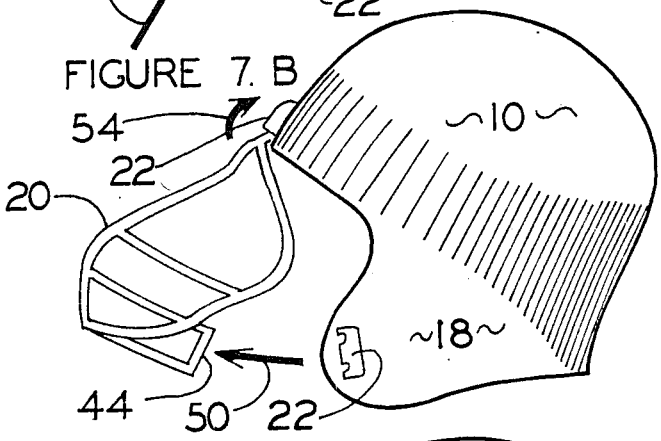
FIGURE 7. B
54
22
~10~
20
~18~
44
50
22
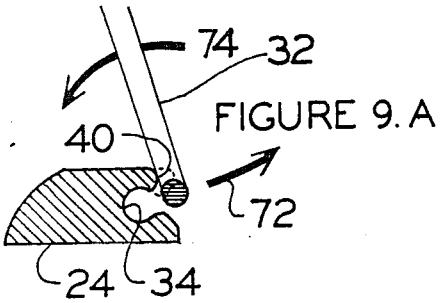
74
32
FIGURE 9. A
40
72
24
34
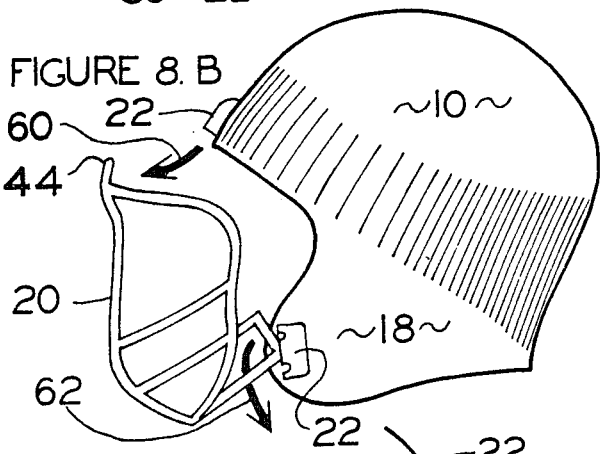
FIGURE 8. B
60
22
~10~
44
20
~18~
62
22
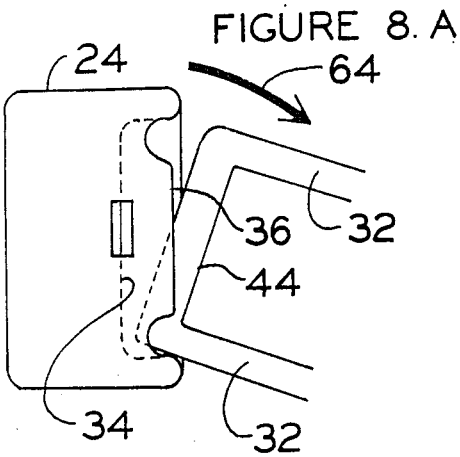
FIGURE 8. A
24
64
36
32
44
34
32
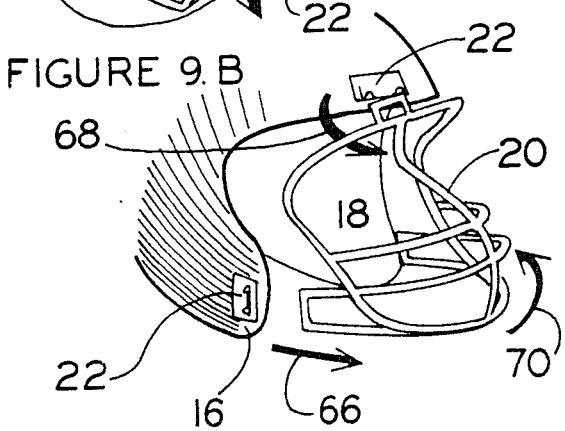
22
FIGURE 9. B
68
20
18
22
16
66
70

ATHLETIC HELMET FACE MASK ATTACHMENT

BACKGROUND OF THE INVENTION

The field of the invention pertains to athletic helmets and face masks that are subject to repeated impacts in the normal course of an athletic contest. Such helmets and face masks are used in contact sports such as football and ice hockey. The face mask must be solidly affixed to the helmet and remain in place despite jarring impacts from the front, side or from above. The face masks are typically fastened with rivets, bolts or other permanent fasteners.

Unfortunately, in the heat of the game the face mask may be grabbed by another player and violently pulled or twisted accidentally or purposely with potentially disastrous injuries to the player. Permanent devastating neck injuries can result ending the carrier of the player and causing paralysis.

The need for a break-away face mask that will remain solidly attached during normal play but come loose with sufficient pulling or twisting forces applied to the mask has been apparent since helmets with face masks have become popular and generally required. Unfortunately, the almost mutually exclusive requirements of an impact and jar resistant attachment that allows detachment with pulling or twisting has apparently thwarted the development of a practical detachable face mask.

SUMMARY OF THE INVENTION

The new attachment configuration for the face mask of a football or ice hockey helmet comprises three snap-in attachments that permit detachment of the face mask with sufficient pulling or twisting movement of the mask. Each snap-in attachment comprises a plastic clip fastened to the helmet and formed with an elongated aperture. A U-shaped bar extends from the mask with the bottom of the U adapted to snap into the aperture and the legs of the U relatively short in comparison with the length of the bottom of the U. The aperture is formed with a narrow slit extending between two wider openings adapted to accommodate the portions of the U-shaped bar extending away from the socket to the mask. The wider portions of the aperture are formed to also extend in a direction perpendicular to the slit.

The configuration of the snap-in attachment resists without detachment sudden impacts and jarring regardless of the direction of the blow to the helmet or face mask. Thus, the attachments prevent removal of the face mask from the helmet in normal play. Pulling or twisting movements of the mask with sufficient force, caused accidentally or purposely by grabbing the face mask in play, causes the U-shaped bars to pull or twist free of the attachments thereby reducing the likelihood of neck injury to the player.

The attachments to the helmet can be molded or otherwise formed very inexpensively of nylon or a similar plastic and bolted or riveted to the helmet body. The U-shaped bar can be simply welded to the wire frame of a football face mask or welded to the metal face mask of an ice hockey helmet.

FIGS. *6a*, *6b* and *6c* illustrate the action of the attachment undergoing thrust or impact against the face mask;

FIGS. *7a* and *7b* illustrate the action of the attachment undergoing a pulling, snap-out and upward pivoting action applied to the face mask;

FIGS. *8a* and *8b* illustrate a pulling and pivoting out action of the face mask and attachment; and FIGS. *9a* and *9b* illustrate detachment of the face mask with a prying out action.

DESCRIPTION OF THE PREFERRED EMBODIMENT

Figure 1:
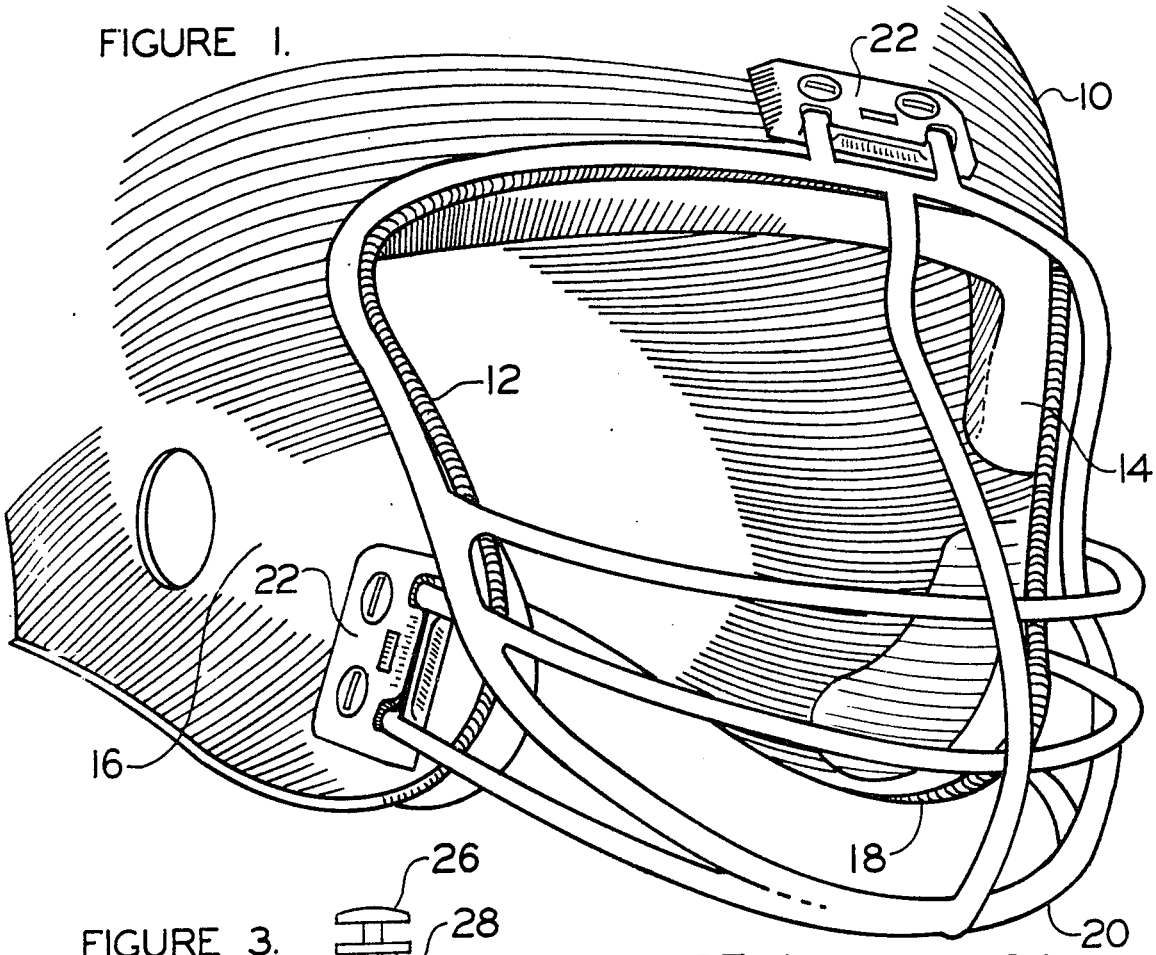
FIG. 1 is a partial perspective view of a football helmet equipped with the new attachments for the face mask.
Figure 3:
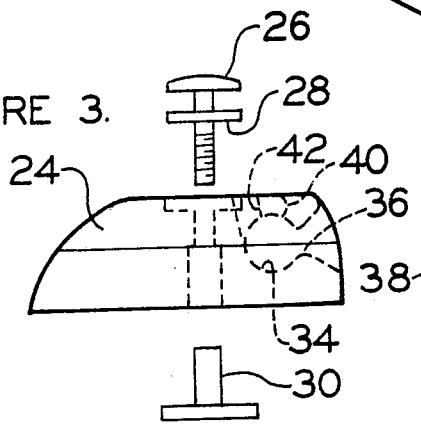
FIGS. 3, 4 and 5 are respectively end, front and top views of the attachment.
Figure 4:
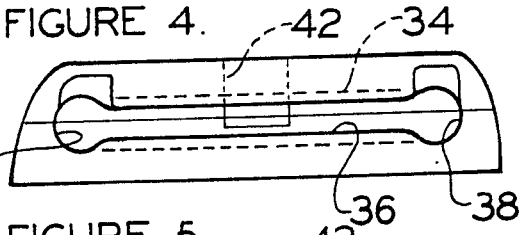
Figure 5:
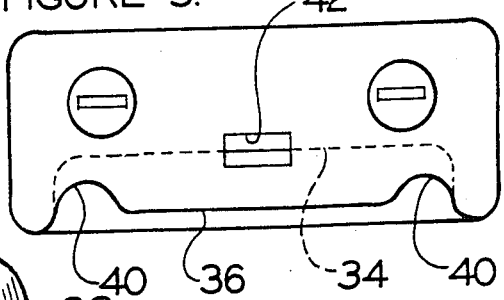
Figure 2:
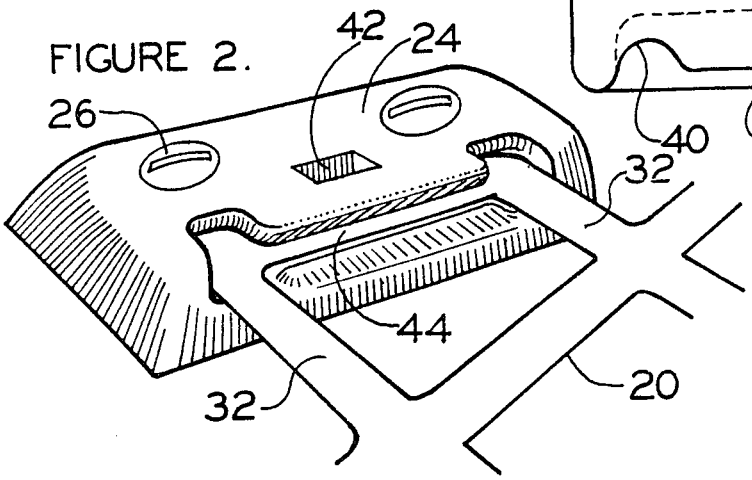
FIG. 2 is a perspective view of a single attachment.

Illustrated in FIG. 1 is the front portion of a typical football helmet 10 having a facial opening defined by a perimeter 12 and also having suitable padding 14 therein. The helmet, usually formed of a relatively hard rigid plastic, includes cheeks 16 and 18 on either side of the helmet facial opening. In front of the helmet facial opening is a face guard or mask 20 formed of steel rod welded together and sometimes coated with athin layer of plastic.

Affixed to the helmet above the forehead and to each cheek 16 and 18 are three attachments 22 which retain the face mask 20 to the helmet 10. Referring to FIGS. 2 through 5 each attachment 22 comprises a split socket body 24 constructed of a tough plastic, such as nylon, and which is affixed to the helmet with screws 26, washers 28 and T-nuts 30 or also rivets. Extending from the face mask 20 is a complementary shallow U-shaped bar or rod 32 having the legs thereof welded or otherwise permanently fastened to the face mask 20.

The socket body 24 is formed with an elongated socket 34 and an elongated slit 36 communicating therewith. At either end of the slit 36 is a substantial widening 38 to conveniently permit the legs of the U-shaped complementary rod 32 to extend out of the socket 34. The widening 38 extends upwardly into the top of the socket body 24 as shown at 40 providing a partial opening substantially perpendicular to the opening slot 36.

The socket body 24 is also equipped with a second small slot 42 centrally located with respect to the socket 34 and extending from the top of the socket body 24 to the back edge of the socket 34. The slot 42 is a safety feature that enables a screwdriver, as illustrated below in FIG. *7a*, to be inserted in the slot 42 behind the bottom 44 of the complementary shallow U-shaped rod 32. The face mask 20 can thereby be removed quickly and easily with a simple screwdriver in the event of an emergency and without inadvertently twisting or pulling on the player's helmet, head or neck.

FIGS. *6a*, *6b* and *6c* indicate with arrows that sudden impacts, pressure and force directed against the face mask 20 and helmet 10 retain the face mask attached to the helmet. Frontal blows and side blows indicated by the arrows 46 drive the face mask 20 tighter into the socket body 24. Thus, the mask is tightly retained to the helmet because there is no tendency to pull or twist at the attachments 22 of the face mask 20 to the helmet 10. In FIGS. *6a* and *6b* the arrows 48 indicate the forces applied to the shallow U-shaped rod 32 attachment to the socket body 24.

FIGS. *7a* and *7b* illustrate the first example wherein a pull to the bottom of the face mask causes a disengagement. As shown the pull, illustrated by arrow 50, causes the two lower attachments 22 to the cheek areas 16 and 18 to disengage from the bottoms of the U-shaped rods 44. The disengagement from the socket body 24 is also illustrated in FIG. 7*a* by arrow 52. The face mask 20 pivots about the attachment 22 at the forehead of the helmet 10 as indicated by arrow 54 in FIG. 7*b*. Thus, rather than twisting the player's head backward about his neck, the face mask merely pivots about the forehead. The pivoting about the attachment 22 at the forehead is permitted by the pair of extended openings 40 in the top of the socket body 24 referred to in FIG. 5. Also illustrated in FIG. 7*a* is the use of the screwdriver 56. By insertion into the central slot 42 and a movement as shown by arrow 58, the bottom 44 of U-shaped rod 32 pops loose from the bottom of the socket 34.

FIGS. 8*a* and 8*b* illustrate further modes of release of the face mask 20 from the helmet 10. A downward pull on the face mask 20 unsnaps the mask directly from the forehead attachment 22 and causes the face mask 20 to pivot about the two cheek attachments 22 to completely release the mask. As shown by arrow 60 in FIG. 8*b* the upper portion of the mask 20 moves forward. As shown by arrow 62 the lower portion of the mask pivots about the cheeks 16 and 18 of the helmet 10. As illustrated in FIG. 8*a*, the socket body 24 and socket 34 are configured to permit the shallow U-shaped rod 32 to initially pivot about one end of the bottom 44 of the shallow U-shaped rod 32 as indicated by arrow 64. The pivoting pries the bottom 44 through the aperture 36 to release the attachment.

Referring to FIGS. 9*a* and 9*b* the face mask 20 is twisted about helmet cheek 18 causing release of the attachments 22 on cheek 16 and at the forehead of the helmet. The twisting movement is shown by the arrows 66, 68 and 70 as the mask 20 is pivoted about the player's left cheek. The mask pivots and rotates in the attachment on the cheek 18. Sufficient rotation in an attachment 22 which may happen in the situation shown in FIG. 9*b* or about the forehead in the situation shown in FIG. 7*b* will cause the bottom 44 of the complementary U-shaped rod 32 to lever about the extended upward opening 40 as best shown in FIG. 9*a*. The movement is shown by the arrows 72 and 74 which indicate the motion to pop loose the attachment.

We claim:

1. An athletic helmet comprising, a helmet body generally shaped to fit about a player's head and a face mask extending over the player's face, attachment means to detachably affix the face mask to the helmet body, the attachment means comprising a plurality of shallow U-shaped sockets on the helmet body and complementary shallow U-shaped rods affixed to the face mask, said U-shaped sockets and U-shaped rods extending generally parallel to the adjacent edges of the helmet body opening about the face of the player.

2. The helmet of claim 1 wherein each U-shaped rod has the legs of the U affixed to the face mask and the bottom of the U insertable in the corresponding socket.

3. The helmet of claim 2 wherein each U-shaped socket comprises two apertures opening into the socket and sized to accept the legs of the U-shaped rod and a slit aperture extending between the two apertures and sized to permit the bottom of the U-shaped rod to be forcefully snapped into and out of the bottom of the U-shaped socket.

4. The helmet of claim 3 including a separate aperture opening into the bottom of the U-shaped socket and extending generally perpendicular to the slit aperture.

5. The helmet of claim 3 wherein the pair of apertures open in directions both perpendicular to the slit aperture and parallel to the slit aperture.

6. The helmet of claim 1 wherein said sockets are affixed above the forehead and outside each cheek all adjacent the face opening of the helmet.

7. The helmet of claim 6 wherein the elongated sockets are shallow U-shapes and the elongated rods comprise shallow U-shaped rods having the legs of the U affixed to the face mask and the bottom of the U insertable in the socket.

8. The helmet of claim 7 wherein each U-shaped socket comprises two apertures opening into the socket and sized to accept the legs of the U-shaped rod and a slit aperture extending between the two apertures and sized to permit the bottom of the U-shaped rod to be forcefully snapped into and out of the bottom of the U-shaped socket.

9. The helmet of claim 8 including a separate aperture opening into the bottom of the U-shaped socket and extending generally perpendicular to the slit aperture.

10. The helmet of claim 8 wherein the pair of apertures open in a direction perpendicular to the slit aperture as well as parallel to the slit aperture.

11. Attachments to detachably fasten a face mask to an athletic helmet comprising, a plurality of shallow U-shaped sockets affixable to the helmet about the face opening of the helmet, a plurality of elongated shallow U-shaped rods each having the legs of the U-shape affixable to the face mask and the bottom of the U-shape insertable into the bottom of the U-shaped socket.

12. The attachments of claim 11 including a pair of apertures in each U-shaped socket sized to accept the legs of the U-shaped rod and a slit aperture extending between the two apertures and sized to forcefully permit the bottom of the U-shaped rod to be snapped into and out of the bottom of the U-shaped socket.

13. The attachments of claim 12 wherein the pair of apertures open in directions both parallel and perpendicular to the slit aperture.

14. The attachments of claim 12 including a separate aperture opening into the bottom of the U-shaped socket and extending generally perpendicular to the slit aperture.

* * * * *